US005444327A

United States Patent [19]

Treseder et al.

[11] Patent Number: 5,444,327

[45] Date of Patent: Aug. 22, 1995

[54] ANISOTROPIC PYROLYTIC GRAPHITE HEATER

[75] Inventors: Robert C. Treseder, Salt Lake City, Utah; Thomas J. Grant, Cupertino, Calif.

[73] Assignee: Varian Associates, Inc., Palo Alto, Calif.

[21] Appl. No.: 86,271

[22] Filed: Jun. 30, 1993

[51] Int. Cl.[6] ..... H01J 1/22

[52] U.S. Cl. ..... 313/337; 313/37

[58] Field of Search ..... 313/15, 37, 270, 311, 313/336, 337, 346 R; 445/35, 50, 51

[56] References Cited

U.S. PATENT DOCUMENTS

| | | | |
|---|---|---|---|
| 4,178,530 | 12/1979 | Lersmacher et al. | 313/337 |
| 4,288,717 | 9/1981 | Tanji et al. | 313/311 |
| 4,344,012 | 8/1982 | Hübner et al. | 313/311 |
| 5,015,908 | 5/1991 | Miram et al. | 313/37 |

*Primary Examiner*—Sandra L. O'Shea
*Assistant Examiner*—Vip Patel
*Attorney, Agent, or Firm*—Bella Fishman; Allan M. Lowe

[57] ABSTRACT

A heater for an indirectly heated vacuum tube cathode is formed of anisotropic pyrolytic graphite in which current passes through the graphite in the "c" direction.

12 Claims, 2 Drawing Sheets

ANISOTROPIC PYROLYTIC GRAPHITE HEATER

FIELD OF INVENTION

The present invention relates generally to heaters for electron emitters, i.e., cathodes, of vacuum tubes and more particularly to such a heater formed of anisotropic pyrolytic graphite in which current passes through the graphite in the "c" direction.

BACKGROUND ART

Cathode heaters of modern vacuum electron tubes generally include a length of wire formed of a refractory metal, such as tungsten, molybdenum, rhenium or a refractory alloy, such as tungsten-rhenium. The wire is usually bent into a convenient shape, such as a flat spiral or a zig-zag configuration, or a cylinder or toroid.

For proper operation, the heater wire is electrically insulated from the cathode which it heats, as well as from any supporting structure of the heater itself. Electric insulation between the heater and the remaining components is typically provided by maintaining an adequate distance between the heater and the remaining structure, as in the case of a free-standing heater. Alternatively, the heater wire is coated with an insulating layer, such as alumina, as in the case of a cataphoretically coated heater. In still another arrangement, the heater is electrically insulated from the surrounding structure by placing a separate insulation component between the heater and the surrounding structure, as in the case of a captured heater. A further structure for electrically insulating the heater from the surrounding structure involves embedding the heater wire in an insulating potting material, as in the case of a potted heater. Combinations of the above structures are widely used. In summary, the typical modern prior art heater for an indirectly heated cathode of a vacuum electron tube is basically an insulated, bent wire made of refractory, electrically conducting material that is electrically insulated from structures in proximity to it.

For most modern indirectly heated cathode applications, the bent electrically conducting, refractory heater is suitable. A disadvantage, in certain situations, with the typical modern heater is that it requires a substantial length of time, such as one minute, to achieve the temperature required for emission of electrons from the cathode. There are certain applications wherein the cathode must achieve emission in a matter of seconds or which require a greater efficiency in transferring heat to the cathode. In addition, there are certain applications in which the entire vacuum tube, including the heater, must be able to survive severe shock and vibration loading.

While potted heaters seem to be the best able to withstand shock and vibration loading, the potting material has a great deal of thermal mass. The potting material thermal mass substantially increases the tube warm-up time, i.e., the time between the initial application of current to the heater and the emission of electrons from the cathodes. While tube warm-up time can be reduced by decreasing the amount of potting material, this solution is not usually satisfactory because the reduction in the potting material weakens the integrity of the structure, thereby making it prone to failure due to thermal and mechanical shock. While the other types of heaters mentioned above have low thermal mass, they cannot, to our knowledge, be made to survive severe shock and vibration loading.

Pyrolytic graphite, which is manufactured by chemical vapor deposition at high temperatures, has been suggested and attempted for heaters of indirectly heated cathodes. It was thought that pyrolytic graphite heaters would enable the goals of fast warm-up and mechanical ruggedness to be attained because the resulting material is laminar and exhibits extreme anisotropic material properties. The structure of pyrolytic graphite is characterized by basal planes wherein carbon atoms are arranged in a precise hexagonal pattern. The basal planes of single-crystal graphite are orderly stacked, but the planes of pyrolytic graphite are somewhat randomly stacked.

The direction parallel to the basal planes, known as the "a" direction (which is the direction of the crystallographic "a" axis), is characterized by high tensile strength, low thermal expansion, high thermal conductivity and moderate electrical conductivity. For example, pyrolytic graphite deposited on an insulating substrate at a temperature of 2100° C. exhibits the following characteristics in the "a" direction at 25° C.

TABLE I

| Property | Value in "a" Direction |
|---|---|
| Electrical resistivity | $700 \times 10^{-6}$ Ohm-cm |
| Thermal conductivity | 3300 BTU/hr-ft$^2$-F/in |
| Linear thermal expansion (from 0° C. to 1000° C.) | $1.5 \times 10^{-3}$ in/in |
| Modulus of elasticity (pure tension) | $4.29 \times 10^6$ psi |
| Tensile strength | $10 \times 10^3$ psi |
| Compressive strength | $15 \times 10^3$ psi |

In the past, heaters and other elements of discharge tubes have employed pyrolytic graphite wherein the planes of pyrolytic graphite are stacked or deposited in the "a" direction on a thin anisotropic pyrolytic boron nitride (APBN) substrate. In the latter instance, the graphite is selectively removed so that only a sinuous conductive pattern remains on the insulating surface of the APBN substrate. Electric current passes through the pyrolytic graphite in the "a" direction. While heaters of this type can be made very thin for fast warm-up, there are problems. Adhesion between the pyrolytic graphite and APBN substrate is very weak, whereby thermal stresses during warm-up often cause the pyrolytic graphite layers to separate from the APBN and themselves. To establish electrical connections to the heater, leads are brazed directly to the pyrolytic graphite surface. It has been found very difficult to achieve good brazes with pyrolytic graphite because of the smooth laminar structure thereof, as well as the low tensile strength of the pyrolytic graphite in the plane at right angles to the "a" direction; the plane at right angles to the plane of the "a" direction is known as the "c" direction, which is the direction of the crystallographic "c" axis.

Pyrolytic graphite, in isotropic form, was employed in the latter part of the nineteenth century as a filament in incandescent electric lamps. In the beginning of the twentieth century, tungsten replaced pyrolytic graphite as the preferred material, causing pyrolytic graphite to fall into disuse as a heater for electric lamp filaments. Since the beginning of the twentieth century, tungsten has become the standard material for heating filaments for most applications, including electron guns, i.e., cathodes, for microwave tubes. Tungsten replaced pyrolytic graphite because the graphite had a tendency to separate from a carrier or substrate therefor; further, the layers of anisotropic graphite separated from each other.

THE INVENTION

In accordance with the present invention, a heater for an electron emitter of a vacuum tube comprises anisotropic pyrolytic graphite arranged so that current passes through the graphite structure in the "c" direction, i.e., in a direction at right angles to the basal planes of the graphite structure; in the basal planes, the carbon atoms of the graphite are arranged in a precise hexagonal pattern. By arranging the graphite so current passes through it in the "c" direction, fast warm-up time and mechanical stability are achieved. The "c" direction has advantages over the "a" direction of higher compressive strength than the "a" direction, higher thermal coefficient of expansion, lower thermal conductivity and much higher electrical resistivity. In particular, anisotropic pyrolytic graphite deposited in the "c" direction on an APBN substrate at a temperature of 2100° C. has the following characteristics while operating at 25° C.:

TABLE II

| Property | Value in "c" Direction |
|---|---|
| Electrical resistivity | 0.5 ohm-cm |
| Thermal conductivity | 13 BTU/hr-ft$^2$-F/in |
| Linear thermal expansion (from 0° C. to 1000° C.) | $25 \times 10^{-3}$ in/in |
| Modulus of elasticity (pure tension) | $1.55 \times 10^6$ psi |
| Tensile strength | approx. 500 psi |
| Compressive strength | $50 \times 10^3$ psi |

The properties of anisotropic pyrolytic graphite in the "c" direction are to be compared with those noted above for the "a" direction, under the same circumstances. Heaters, in accordance with the invention, can be mechanically configured so they are very compact and rugged. Because the heaters have very low thermal mass, the warm-up time is quite fast. Preferably the structure is configured as plural, stacked basal planes having the shape of a circle of revolution about a central axis defining a longitudinal axis of the heater. The resulting configuration has a pair of opposite end edges to which electrical conductors are connected so that current passes at right angles to the basal planes parallel to the longitudinal axis.

The structure can be configured either as a sleeve or as a cylinder. In the former case, heat is generally transferred by radiation within the vacuum electron tube from the heater to a cathode mounted centrally with the sleeve. For heaters configured as cylinders, the cylinder is connected in a heat conduction path to the cathode, thereby to provide greater heat transfer efficiency.

A further advantage of the structure is current flow through the heater does not have an impact on the tube magnetic field. This is particularly important in certain types of tubes, particularly travelling wave tubes and magnetrons which rely on external magnetic fields for proper operation. It is, accordingly, an object of the present invention to provide a new and improved heater for vacuum electron tubes.

It is another object of the present invention to provide a new and improved rugged cathode heater for vacuum electron tubes.

A further object of the present invention is to provide a new and improved pyrolytic graphite cathode heater for vacuum electron tubes.

An additional object of the present invention is to provide a new and improved highly efficient, rugged cathode heater for vacuum electron tubes, which heater is capable of warm-up times that are a small fraction of a minute, e.g., less than five seconds.

Still another object of the present invention is to provide a new and improved vacuum electron tube cathode heater which is simple and can be inspected and modified prior to being mated with the cathode it is to heat.

Another object of the present invention is to provide a cathode heater for vacuum electron tubes having external magnetic fields applied to them, such as travelling wave tubes and magnetrons, wherein the current applied to the heater produces a magnetic field that does not interact with the external magnetic field.

DESCRIPTION OF THE PREFERRED EMBODIMENTS

Figure 1:
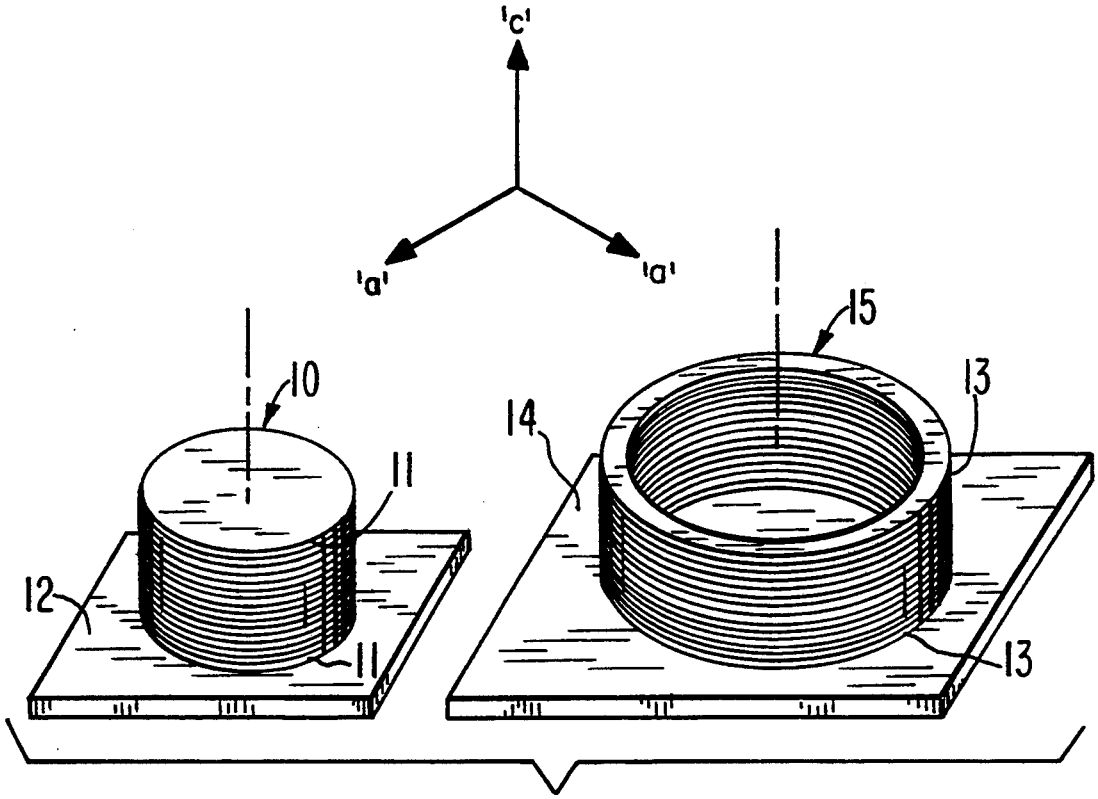
FIG. 1 is a drawing useful in describing the nature of the "a" and "c" directions of anisotropic pyrolytic graphite.

Reference is now made to FIG. 1 of the drawing wherein cylinder 10 includes basal planes 11 of anisotropic pyrolytic graphite formed by a deposition process in the usual manner on substrate 12. The portion of cylinder 10 abutting substrate 12 is initially deposited on the substrate so the basal plane thereof, generally illustrated in FIG. 1 as being in the horizontal direction, is parallel to the plane of substrate 12. After the portion of cylinder 10 abutting substrate 12 has been deposited on the substrate, the remainder of the cylinder is sequentially deposited on the substrate so basal planes 11 thereof are all parallel to each other.

A similar deposition process is used to form anisotropic pyrolytic tube 15 on substrate 14. Basal planes 13 of tube 15 are parallel to each other and to the plane of substrate 14. After cylinder 10 or tube 15 has been formed, substrate 12 or 14 is removed from the cylinder or tube by any suitable known process.

Figure 2:
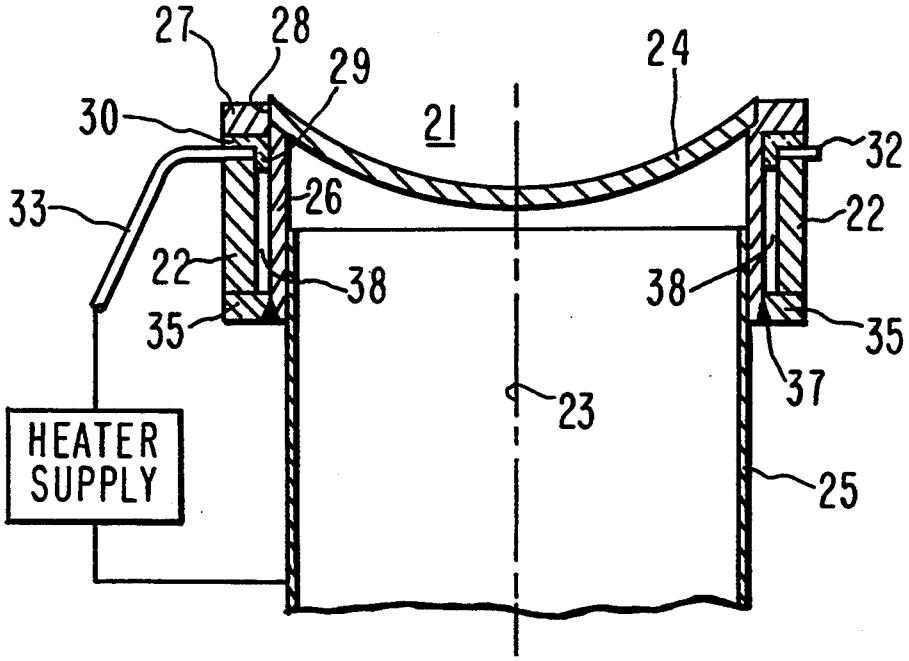
FIG. 2 is a side sectional view of a first embodiment of a heater in accordance with the present invention, in combination with a dispenser cathode that is heated by radiation from the heater.
Figure 3:
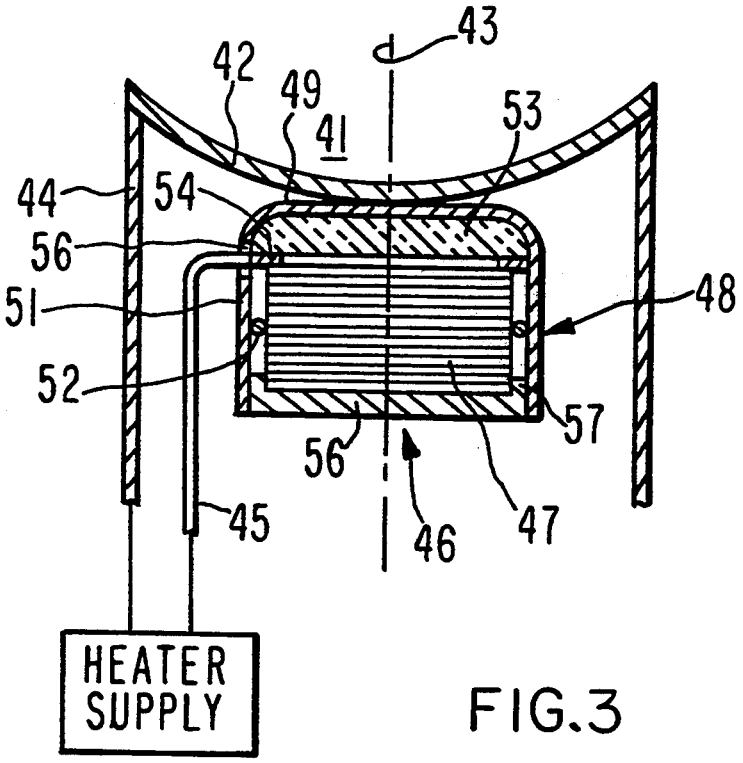
FIGS. 3 and 4 are side views of first and second heaters for conductively heating dispenser cathodes.
Figure 4:
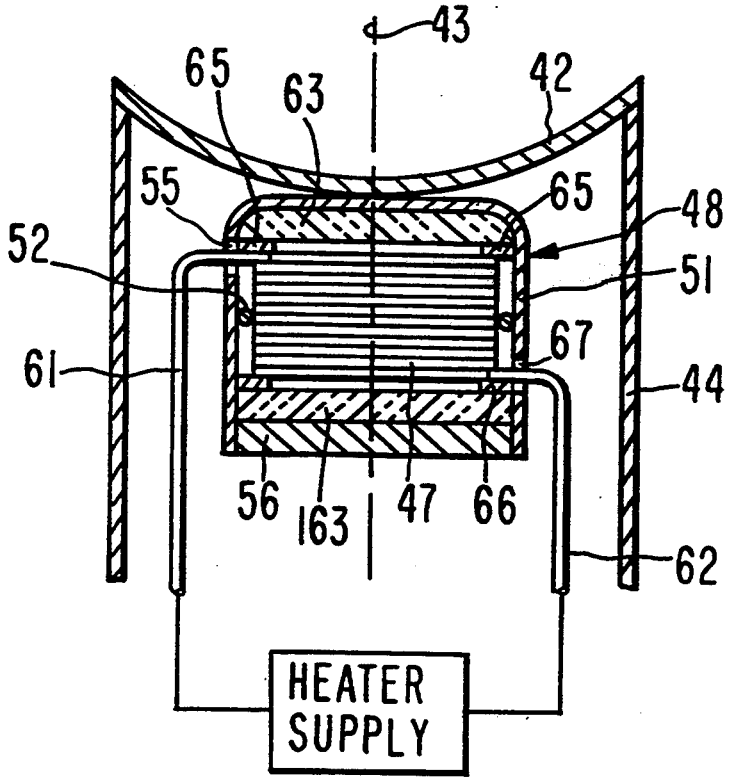

Basal planes 11 and 13 are said to extend in the "a" direction of the anisotropic pyrolytic graphite. The plane at right angles to basal planes 11 and 13, in the vertical direction in FIG. 1, is referred to as the "c"

direction. In FIGS. 2–4, the basal planes are not specifically illustrated, but it is assumed that the basal planes are arranged in the manner indicated in FIG. 1 for cylinder 10 and tube 15. In accordance with the present invention, electrical conductors are connected to the parallel faces or edges at the top and bottom of cylinder 10 or tube 15 so current flows through the cylinder and tube in the "c" direction of the anisotropic pyrolytic graphite.

Reference is now made to FIG. 2 of the drawing wherein cathode assembly 21 is illustrated as including anisotropic pyrolytic graphite heater having a tube configuration 22, similar to that described in connection with tube 15, FIG. 1. Tube 22 is concentric with axis 23 that defines the center line of cathode assembly 21 and dispenser cathode 24, having a circular periphery and concave shape. Cathode 24 is heated by radiation and conduction from heater 22 to emit electrons in a microwave vacuum tube containing cathode assembly 21; exemplary of the types of the tubes in which cathode assembly 21 is included are travelling wave tubes (TWTs) and klystrons. Ten amperes per square centimeter is a typical density for the beam derived from cathode 24.

Cathode assembly 21 is mounted on cathode support 25, shaped as a tube concentric with axis 23. Cathode support 25 is preferably an alloy of molybdenum and rhenium (MoRe) which is employed because it remains ductile and does not recrystallize when exposed to the high temperature of heater 22. Metal cathode support 25 is part of a return path for current flowing through heater 22, to assist in establishing an electric connection between cathode 24 and a power supply for it.

Extending from and connected to the upper outer surface of cathode support tube 25 is cylinder 26, having a wall thickness considerably greater than that of tube 25, and made of a refractory metal, such as molybdenum or an alloy of molybdenum-rhenium. Cylinder 26 is bonded to the outer upper surface of cathode support tube 25 so the cylinder is concentric with axis 23. Cylinder 26 includes flange 27 that extends from the end of the cylinder remote from tube 25 in a radial direction away from center line 23. The interior wall of cylinder 26 includes indentation 28 in the region of flange 27 for receiving the edges of cathode 24, which edges are bonded in-situ to walls constituting the indentation.

Ring 29 including flange 30 is preferably bonded to the intersecting surfaces of the exterior wall of cylinder 26 and flange 27. Ring 29 including flange 30 is an electrical insulator, preferably formed of the dielectric APBN. Washer 32 is force-fitted against the lower face of flange 30 and the exterior wall of ring 29; the inner periphery and upper face of washer 32 abut the outer wall of ring 29 and the lower face of flange 30. Washer 32 is formed of a refractory metal, such as an alloy of titanium and zirconium. The lower face of washer 32 is force fitted against the upper edge of heater 22. Refractory metal lead wire 33, preferably an alloy of molybdenum and rhenium, is brazed by a titanium diffusion bond to the tip of flange 30. The titanium diffusion bond preferably is formed in such a manner as to prevent melting of pyrolytic graphite heater 22.

After heater 22 has been press-fitted against washer 32, with the washer in place against ring 29 and the ring bonded to cylinder 26, manufacture of the heater assembly is completed by placing ring 35 against the exposed edge of heater 22 by slipping the ring onto cylinder 26 so the inner surface of the ring abuts the outer surface of the cylinder. Ring 35 is made of a refractory metal, such as molybdenum, or an alloy of molybdenum and rhenium. The abutting surfaces of ring 35 and cylinder 26 are bonded together by laser weld 37. Space 38, between the concentric exterior wall of cylinder 26 and the interior wall of the tube forming heater 22, provides the electric isolation needed for proper operation of heater 22.

In operation, current flows from lead 33 through heater 22, i.e., in the "c" direction of anisotropic pyrolytic graphite heater 22, to ring 35. The current then flows radially through ring 35 and cylinder 26 to cathode support tube 25. The resistance of heater 22 is similar to that of a wire heater to provide optimum heating which enables full electron emission from the cathode in 1 to 5 seconds from the time current is first applied to lead 33. The configuration of FIG. 2 is mechanically stable because of the high compressive strength of the anisotropic pyrolytic graphite heater in the "c" direction and the high thermal coefficient of expansion of the heater in the "c" direction between flange 30 of ring 29 and ring 35. The high thermal coefficient of thermal expansion in the direction parallel to axis 23 causes superior contact to be established between the opposite edges of heater 22 and the lower face of washer 32 and the upper face of ring 35. Heater 22 has a greater coefficient of thermal expansion in the direction parallel to axis 23 than any of ring 29, washer 32 or ring 35 to establish a significant compressive force of the heater against lead 33. The force fit of heater 22 against the parts which it abuts obviates the need to braze the graphite heater to these parts. If heater 22 should become delaminated or if flange 30 should become separated from flange 27, this compressive force developed in the heater is such that operation of the device is not impaired.

A further advantage of the design of FIG. 2 is that final alterations to the resistance of heater 22 are possible after cathode assembly 21 has been built. The heater resistance can be altered by mounting assembly 21 on a clean lathe and turning the diameter of heater 22 to achieve the proper heater resistance. Still another advantage of the construction of FIG. 2 is that the magnetic field established by current flowing through heater 22 has negligible effect on the magnetic field at the emitting surface of cathode 24.

Reference is now made to FIG. 3 of the drawing wherein cathode assembly 41 is illustrated as including concave dispenser cathode 42 and heater assembly 46 including anisotropic pyrolytic heater 47, constructed and formed in the same manner as cylinder 10, FIG. 1. Cathode 42 has a circular periphery and a center line 43 that defines the cathode assembly longitudinal axis. Dispenser cathode 42 is fixedly mounted on metal sleeve 44, preferably formed of a refractory metal, such as molybdenum or an alloy of molybdenum and rhenium. Tube 44 is concentric with axis 43 and is electrically connected to one terminal of a heater supply source and to a power supply terminal for electrodes of the microwave electron tube of which heater assembly 41 is a part. Another terminal of the heater supply is connected via lead 45 to heater assembly 46. Thus, the "c" direction of heater 47 extends in the same direction as axis 43, in the same manner that the "c" direction of heater 22 extends in the same direction as axis 23.

Heater assembly 46 is arranged so current passes in the "c" direction through anisotropic pyrolytic heater 47 and heat is conductively transferred from heater 47 to dispenser cathode 42. Further, as heater 47 expands in the "c" direction, along axis 43, the thermal conductivity between the heater and dispenser cathode 42 increases.

To these ends, heater assembly 46 includes cup 48 formed of a refractory metal, preferably molybdenum. Cup 48 includes end 49 that extends generally at right angles to axis 43 and has an exterior face bonded to the surface of cathode 42 opposite the cathode emitting surface. Cup 48 also includes sidewall 51 that extends in generally the same direction as it is concentric with axis 43. Sidewall 51 is spaced from the cylindrical side wall of pyrolytic graphite heater 47 to provide electrical isolation from the heater. To maintain pyrolytic graphite heater 47 in-situ relative to cup 48, dielectric ring 52, preferably fabricated of APBN because of the low temperature coefficient of expansion thereof, is slid over the cylindrical wall of pyrolytic heater 47. The inner and outer peripheries of ring 52 frictionally engage the cylindrical wall of heater 47 and the inner surface of wall 51 of cup 48.

Prior to heater 47 being inserted into cup 48, dielectric APBN spacer 53, having a disc shape mating approximately with the interior face of end wall 49, is placed in cup 48. Then, ring 54, formed of a refractory metal, such as an alloy of molybdenum and rhenium, is placed on spacer 53. Ring 54 has an outer diameter equal approximately to the inner diameter of cup side wall 51 and an inner diameter somewhat less than the diameter of cylindrical heater 47. The opening in the center of ring 54 enables heater 47 to expand along axis 43.

Bonded to ring 54 is lead 45, also fabricated of a refractory metal, preferably molybdenum. Lead 45 projects through slot 58 in wall 51 of cup 48.

After ring 54 has been put in place, heater 47 is deposited in cup 48, on top of the ring. Then, cap 56, formed of a refractory metal, preferably molybdenum, is placed on cup 48 so the side wall of the disc-like cap engages the interior surface of side wall 51 of cup 48. As an alternative to disc 52, cap 56 includes ear 57 that projects into the space between the outer wall of cylindrical heater 47 and inner wall 51 of cup 48. Cap 56 is then secured to side wall 51 by laser bonding.

In operation, current flows from tube 44 through cathode 42 to surface 49 of cup 48, thence to the cup side wall 51. From side wall 51, the current flows through cap 56 and heater 47 in the "c" direction. From heater 47, the current flows through disc 54 to lead 45.

Such operation is highly advantageous because of the relatively high electric resistance of heater 47 in the "c" direction, leading to fast warm-up of cathode 42. As heater 47 increases in temperature, it expands in the direction of axis 43 to increase the compressive force of the heater on ring 54 and cap 56, thereby to provide desired positive contact pressure and an electric connection between heater 47 and ring 54 and cap 56.

Still another embodiment of a heater in accordance with the invention, in combination with dispenser cathode 42, is illustrated in FIG. 4 wherein the opposite edges of anisotropic pyrolytic graphite cylindrical heater 47 are directly connected by lead lines 61 and 62 to opposite terminals of a heater power supply. Heater 47 is located in refractory metal cup 48, in a manner somewhat similar to that described in connection with FIG. 3. However, in the embodiment of FIG. 4, the top and bottom edges, i.e., faces or surfaces, of heater 47 are both electrically insulated from cup 48 by APBN spacers 162 and 63. Sandwiched between the top planar face of heater 47 and spacer 63 is refractory metal disc 65; this is in the same manner that disc 54 is sandwiched between the top edge of heater 47 and spacer 53, FIG. 3.

Lead 61 extends from disc 65 through a slot in cup 48 in the same manner described in connection with FIG. 3. In FIG. 4, however, APBN disc 66 is sandwiched between the lower planar surface of heater 47 and the upper face of disc-shaped end cap 56. Lead 62 extends through relatively short slot 67 in side wall 51 of cup 48 on a portion of the side wall diametrically opposed to the part of the side wall in which slot 55 extends.

The bottom face of spacer 66 abuts against the upper face of disc-shaped end cap 56. To prevent transverse movement of heater 47, boron nitride, dielectric ring 52 is placed between the cylindrical side wall of the heater and interior, cylindrical side wall 51 of cup 48 so the inner and outer edges of the ring abut the side walls. To provide positive support for leads 61 and 62, discs 65 and spacer 66 extend all the way to side wall 51 of cup 48.

In operation, current flows from lead 61, then in the "c" direction through anisotropic pyrolytic graphite heater 47 in the same manner that current flows through the "c" direction of the heater of FIG. 3. From heater 47, current flows through lead 62 back to a power supply terminal.

The same advantages associated with the structure of FIG. 3 are attained with the structure of FIG. 4 relating to (1) low electrical heater resistance, resulting in fast warm-up time, (2) mechanical stability and (3) very positive contact forces, without the need for bonding disc 63 to heater 47. Further, a heat conduction path subsists from heater 47 to cathode 42 from the heater through APBN spacers 63 and 64 and cup 48 which abuts heater 42.

While there have been described and illustrated several specific embodiments of the invention, it will be clear that variations in the details of the embodiments specifically illustrated and described may be made without departing from the true spirit and scope of the invention as defined in the appended claims.

We claim:

1. An indirectly heated cathode for an electron tube comprising: an electron emitter, a heater connected to said emitter for heating said emitter by radiation and conduction, said heater including an anisotropic pyrolytic graphic structure, said heater structure comprising a pair of opposite end edges, electric conductor means connected to said end edges for supplying current from a heater power supply to said heater structure end edges so current flows through said heater structure between said end edges in a direction at right angles to basal planes of said heater structure, and a metal support member electrically and mechanically connected to said emitter and one of said edges for supplying current from one terminal of said supply to said emitter and said one edge.

2. The cathode of claim 1 wherein the support member is tubular and is coaxial with said heater structure.

3. The cathode of claim 2 wherein the heater structure is configured as a tube having first and second opposite edges respectively confined by first and second refractory end members, one of said members being metal, said metal member electrically and mechanically connecting said first edge to said support member, the other member being an electric insulator mechanically connecting said second edge to said support member, an electric lead for supplying current from the heater power supply to said second edge being held in situ between said other member and said second edge.

4. The cathode of claim 3 wherein the first and second end members are configured as rings, one of said rings including a flange having first and second opposite surfaces respectively abutting against end walls of the heater structure and support member.

5. The cathode of claim 3 wherein the heater structure is mounted relative to the emitter so that heat is transferred from the heater structure to the emitter primarily by radiation.

6. The cathode of claim 2 wherein the heater structure is mounted relative to the emitter so that heat is transferred from the heater structure to the emitter primarily by conduction.

7. The cathode of claim 6 further including a metal mass electrically and mechanically connecting one of said edges of said heater structure to said emitter to provide the heat conduction path between said heater structure and said emitter and to provide an electric connection between the heater power supply and said edge via the support member and the emitter.

8. The cathode of claim 6 further including a metal mass mechanically connecting said heater structure to said emitter to provide the heat conduction path between said heater structure and said emitter.

9. The cathode of claim 8, wherein said electric conductor means further connected to the other end edge of the heater structure.

10. The cathode of claim 9 further including first and second electric leads for electrically connecting said first and second edges to opposite terminals of the heater power supply.

11. The cathode of claim 10 wherein the metal mass is configured as a cup having a side wall engaging a side wall of the heater structure and an emitter wall engaging the emitter, a refractory electrical insulator having opposite faces abutting respectively against the first edge and the emitter wall of the cup, the side wall of the cup including openings through which the leads extend.

12. The cathode of claim 6 further including an electric lead for electrically connecting said other edge to a terminal of the heater power supply.

* * * * *